United States Patent [19]

Deering

[11] 4,330,021

[45] May 18, 1982

[54] CONVENIENT DRAFT-FREE SAFETY WINDOW

[76] Inventor: John J. Deering, Chicago, Ill.

[21] Appl. No.: 81,373

[22] Filed: Oct. 3, 1979

Related U.S. Application Data

[63] Continuation-in-part of Ser. No. 893,062, Apr. 3, 1978, abandoned.

[51] Int. Cl.[3] ..... A47H 1/00; E06B 3/32

[52] U.S. Cl. ..... 160/91; 49/67; 49/63; 98/88 R

[58] Field of Search ..... 49/62, 63, 67; 160/88 R, 89, 91, 92, 90; 98/88 R, 88 S, 88 L

[56] References Cited

U.S. PATENT DOCUMENTS

| | | | |
|---|---|---|---|
| 2,122,151 | 6/1938 | Luethke | 160/91 |
| 2,226,274 | 12/1940 | Winship | 49/67 |
| 3,012,605 | 12/1961 | Turk | 160/91 |

FOREIGN PATENT DOCUMENTS

| | | | |
|---|---|---|---|
| 67560 | 5/1940 | Czechoslovakia | 49/67 |
| 58881 | 1/1938 | Norway | 49/67 |
| 688097 | 2/1953 | United Kingdom | 49/63 |

*Primary Examiner*—C. J. Husar
*Assistant Examiner*—Cherney S. Lieberman

[57] ABSTRACT

A safety window comprising an inner window including three adjacent inner panels and an outer window including three adjacent outer panels. The outside panes can be washed conveniently and safely from the inside. The inner center panel opens in conjunction with the outer center panel to provide an opening through which an arm can pass for cleaning the outside panes. Sash sections act like bars to eliminate the possibility of falls from the window, and also to prevent entry by burglars or vandals—even when the window is open.

For fresh air, the outer center panel opens in conjunction with an inner side panel to provide an opening through which air can pass. The resulting baffled arrangement of panels prevents direct wind drafts and also entry of rain. A screen, or filter, is interposed crosswise between opposing windows. Translucent glass panes may be utilized to adapt the invention for bathroom use.

8 Claims, 5 Drawing Figures

CONVENIENT DRAFT-FREE SAFETY WINDOW

This application is a continuation-in-part of a copending application, Ser. No. 893,062, filed 4/3/78 now abandoned.

BACKGROUND OF THE INVENTION

This invention relates to safety windows.

Associated with most conventional windows are various problems or inconveniences the alleviation of which is an object of the present invention.

The outsides of most conventional windows are not easily reached from the inside of a building. As a result, someone desiring to clean such a window must lean outside the window to do so if the window is much above ground level or cannot conveniently be reached by ladder. This method of washing windows is not without hazard. Consequently, many windows either go unwashed, or are washed only infrequently. For high-rise buildings, expensive professional window washers must be hired.

The twice yearly processes of putting in and taking out storm windows and screens is another inconvenience associated with conventional windows.

Additionally, most conventional windows offer little resistance to entry of even minimally determined burglars and vandals.

Furthermore, just as conventional window construction allows easy entry, so also does it provide little protection from falling out of the window. Playing children occasionally fall from upper floor windows. The possibility thereof can be a constant source of worry to parents.

Another problem associated with conventional windows is direct wind drafts. The direct air pathway from outside to inside provided by conventional windows for ventilation is advantageous in many situations where good air flow is desired—for quickly cooling off a room in the summer, for example—but direct drafts are often undesirable. A hospital room would provide one example of an area where drafts should be avoided.

Yet another problem associated with conventional windows is entry of rain. An unexpected storm in the middle of the night, or during a period when a building or residence is left unattended, can result in a good deal of water being deposited where it is not wanted.

These problems are alleviated by the invention disclosed herein.

SUMMARY OF THE INVENTION

The present invention comprises an inner window and an outer window. The inner window includes three adjacent preferably vertical window panels—a center and two side panels. The outer window likewise includes three similar panels—two side and one center.

It is an object of the invention to provide a window that can be washed from the inside of a building safely and easily. Accordingly, the outer center panel may be opened in conjunction with the inner center panel to provide an opening through which an arm can pass for cleaning the outsides of the outer side panels from the inside of a building.

The outer center panel opens in conjunction with one of the inner side window panels for ventilation. The resulting indirect air pathway prevents drafts and entry of rain. Between the opening provided by the outer center panel and the opening provided by the inner side ventilating panel, a screen panel is interposed crosswise between inner and outer windows so as to abut against them for an insectproof seal. Thus insects entering the outer center panel opening are prevented from reaching the inner side panel opening.

Since the screen panel is a fixture that need not be removed, and since the outer window acts as a storm window when closed, the invention eliminates the need for changing from screen to storm windows and vice versa. The double window arrangement also provides exceptional energy conservation.

With the outer side panels secured in a closed position, panel sash sections act like bars to keep burglars and vandals out. These sash sections also eliminate the possibility of anyone falling out of the window.

Further features of the present invention will be apparent from the following description with reference to the accompanying drawings.

DESCRIPTION OF THE PREFERRED EMBODIMENTS

Figure 1:
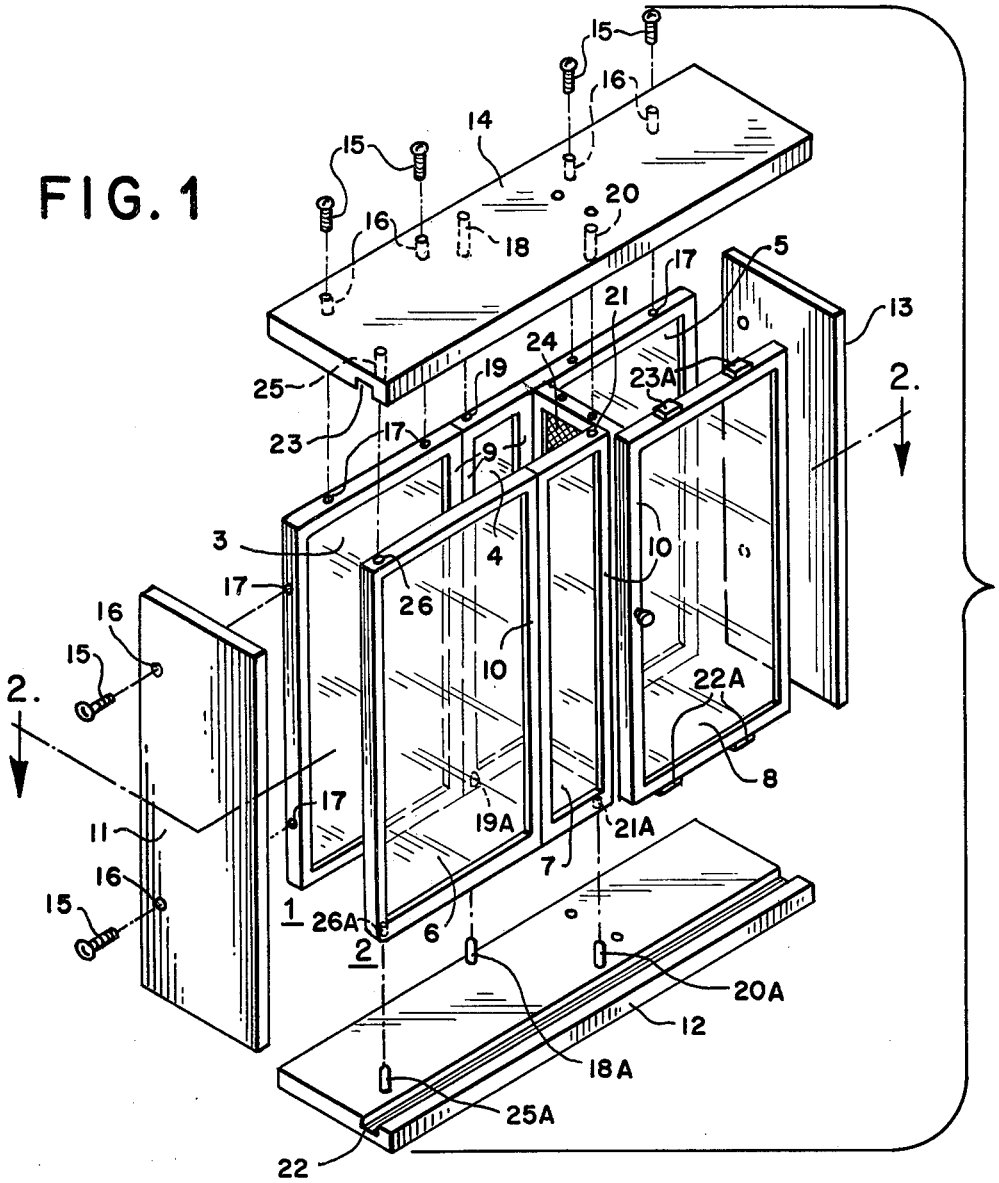
FIG. 1 is a perspective view of the invention, with a suitable frame shown also in exploded perspective.
Figure 2:
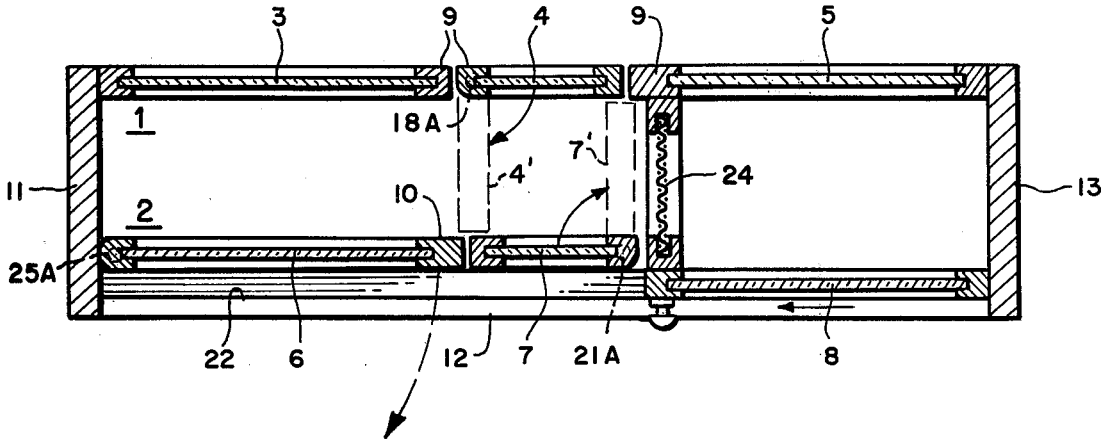
FIG. 2 is a cross sectional view of the invention taken along line 2—2 of FIG. 1.

Referring to FIGS. 1 and 2, the convenient safety window comprises an outer window 1 and an inner window 2. The outer window includes three window panels 3, 4, and 5 lying adjacent one another when in a closed position so as to form a weathertight closure across a window opening, such as defined by frame members 11–14. The inner window includes adjacent panels 6, 7, and 8. The inner panels similarly form a closure across the window opening when in a closed position. Each panel comprises a glass pane and a framework, or sash. Various materials can be used in the construction of the window, the particular application determining the material of choice. Where maximum energy conservation is desired, for example, the panes could be of acrylic and the sash of vinyl or wood. If maximum security were desired instead, the panes could be polycarbonate and the sash steel.

With outer side panels 3 and 5 secured in a closed position, sash sections 9 act like bars to prevent ingress or egress, even when center panel 4 is left open. Panels 3 and 5 may be made permanently stationary for maximum security. In FIG. 1, window frame members 11–14 are shown to which panels 3 and 5 are permanently attached by means of screws 15 passing through holes 16 in the frame members and engaging screw holes 17 in the sash sections. Alternatively, various other conventional means could be used to secure panels 3 and 5 in place, such as locks, or crank arrangements accessible only from the inside for opening and closing the panels.

Inner center panel 7 pivots outward (i.e., towards the outside of a building wherein the window is mounted) and outer center panel 4 pivots inward about an axis diagonally opposed to the pivot axis of panel 7, thus providing an opening through which an arm can pass to wash the outsides of panels 3 and 5. Upper and lower pivot pins 18 and 18A engage pivot hole 19 and a corresponding 19A in the bottom of panel 4 for inward pivoting motion about a vertical axis. Alternatively, panel 4 may be hinged to panel 3 if panel 3 is made permanently stationary. Inner center panel 7 pivots outward (or inward) on upper and lower pivot pins 20 and 20A, these pins being engaged by pivot holes 21 and 21A.

Inner side ventilating panel 8 slides parallel to the inner window in lower guide 22 and upper guide 23 to open. Guide followers 22A and 23A engage the guides. With panels 4 and 8 open, fresh air can enter the window; but since the air path is indirect, drafts are avoided. Rain is also prevented from entering. Panel 8 could be constructed to pivot inward to open, but this mode of opening would result in panel 8 projecting into the room. The sliding mode is therefore preferred.

Between the openings provided by panels 4 and 8, screen panel 24 is interposed crosswise between the inner and outer windows 1 and 2, abutting against portions thereof so as to form an insectproof seal. Since panel 24 is edgewise to anyone looking out of the window, it is even possible to replace the screen with a filter of fiberglass or the like to filter out particulates in addition to insects. The view will not be blocked.

Inner side panel 6 pivots for cleaning at the edge nearest the window opening to the inside on upper and lower pivot pins 25 and 25A, the pins being engaged by pivot holes 26 and 26A.

Figure 3:
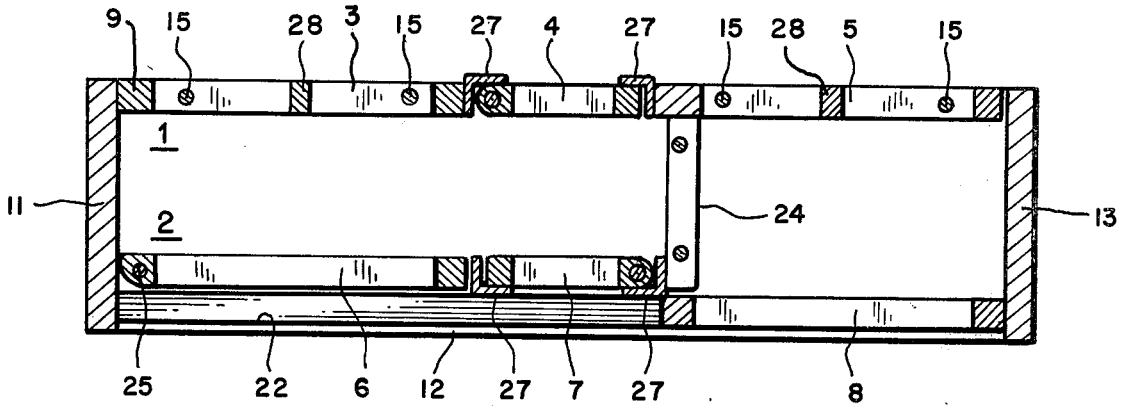
FIG. 3 is a cross sectional view similar to FIG. 2 with supplemental features of the invention shown.

Referring to FIG. 3, supplemental frame members 27 may be provided for additional security. These members extend between suitable upper and lower window frame members. Where window openings are large and panel sash sections would be too widely spaced to provide security, the panels may be subdivided into smaller panes with additional sash sections, such as 28 in FIG. 3, filling in the gaps. It will be observed that panel 7 does not pivot inward in FIG. 3.

Figure 4:
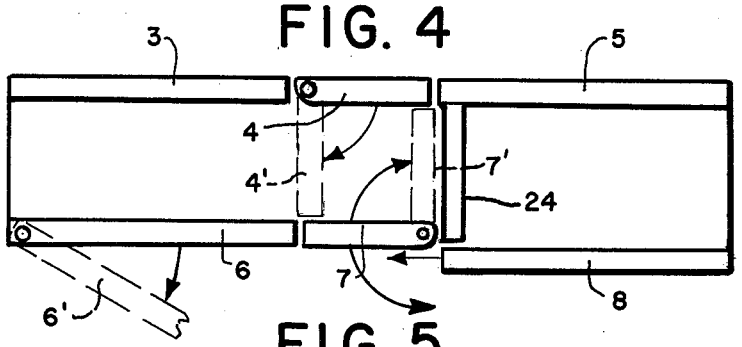
FIGS. 4 and 5 are schematic representations of the invention.
Figure 5:
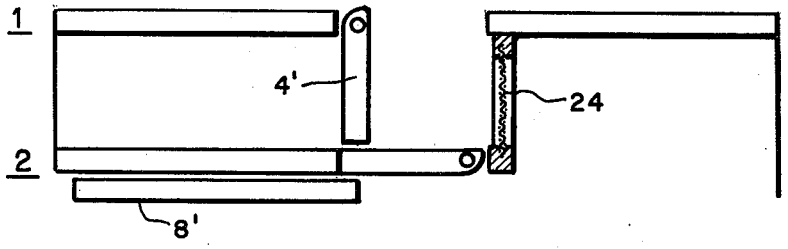

The inventive concept is most clearly displayed in FIGS. 4 and 5, where rectangles represent window panels. FIGS. 4 and 5 are schematic illustrations of the material in FIGS. 1 and 2 (not 3). By "outside surfaces" in the following description we mean those glass surfaces that lie closest to the outside of the window when the panels are closed. By "inside surfaces" we mean those glass surfaces that lie nearest the inside of the building when the panels are closed.

Panels 4 and 7 are securable in a closed position for preventing ingress and egress, sash members acting like bars. Panels 4 and 7 pivot to positions 4' and 7', whereupon an arm can pass through the resulting opening for cleaning the outside surfaces of outer side panels 3 and 5, as well as the outside surface of panel 4. The widths of panels 4 and 7 are preferably less than the distance between inner and outer windows so that in fully open position these panels fit crosswise in the space between inner and outer windows.

It will be observed that all the panels can be cleaned on both sides from the inside with a suitable disposition of panels. With panel 7 open and the other panels closed, the inside surfaces of panel 4 and panel 3 can be cleaned. With inner side panel 6 in open position 6', and the other panels closed, the outside surfaces of panels 6 and 7 can be cleaned, as well as the inside surface of opposing panel 3. With panels 6 and 7 open, and inner side ventilating panel 8 moved to position 8' next to the closed position of panel 6, the outside surface of panel 8 and the inside surface of opposing panel 5 can be cleaned.

Panel 4 opens to the inside of the outer window so as not to block the outer surfaces of the outer side panels.

Panels 4 and 7 are slightly offset from each other so their ends can clear when panel 7 is moved to position 7' and panel 4 is immediately thereafter moved to position 4'. It should be obvious that other simple remedies can accomplish the same end. For example, pulling panel 7 inward followed by pulling panel 4 inward would expose the outer side of the outer window for cleaning without requiring that panels 4 and 7 be offset from each other. If panel 4 were then pivoted more than 90° from its closed position, panel 7 could then be rotated outward to a position analogous to 7', but not requiring that the panels be offset. Likewise, if panels 4 and 7 were crank operated, panel 4 could be opened first, utilizing a greater than 90° turn, and panel 7 then pivoted outward. Again offset panels are not required. It will, therefore, be understood that the invention is not limited to a single construction, or to a particular sequence of operating steps.

I claim:

1. A convenient draft-free safety window comprising:

an outer window including an outer center panel and two outer side panels:

an inner window including an inner center panel, an inner side panel, and an inner side ventilating panel;

said outer panels lying adjacent one another when in a closed position to form a closure across a window opening;

said inner panels likewise forming a closure across a window opening when in a closed position;

said center panels pivoting at diagonally opposite edges to open; said inner center panel pivoting outward, thus making the inside glass surface of the outer center panel accessible for cleaning; and said outer center pivoting inward so that its outside surface can be cleaned; and said center panels having widths less than or equal to the distance between the inner and outer windows so that in fully open position said center panels fit crosswise in the space between inner and outer windows.

2. The window of claim 1 wherein:

said inner side ventilating panel opens in conjunction with said outer center panel to provide an indirect pathway for air to pass through, said ventilating panel being the inner panel farthest from the pivot axis of the outer center panel; and a screen panel is interposed crosswise between inner and outer windows so as to abut against them for an insectproof seal, said screen panel being positioned between the openings provided by the outer center panel and the inner side ventilating panel.

3. The window of claim 2, wherein:

said inner side ventilating panel slides parallel to the inner window to open, thus making the inside surface of the opposing outer side panel accessible for cleaning;

said inner side panel pivots inward about an axis located at the edge nearest the window frame, thus making accessible for cleaning its outside surface, the inside surface of the opposing outer side panel, and the outside surface of the inner center panel; and said inner side ventilating panel slides parallel to the inner window, while said inner side panel and said inner center panel are open, to a position next to the closed position of the inner side panel, thus making its outside surface accessible for cleaning from the opening provided by the inner center panel.

4. The window of claim 1, wherein:

said inner side ventilating panel opens in conjunction with said outer center panel to provide an indirect pathway for air to pass through, said ventilating panel being the inner side panel farthest from the pivot axis of the outer center panel; and a filter panel is interposed crosswise between inner and outer windows so as to abut against them for a seal, said filter panel being positioned between the openings provided by the outer center panel and the inner side ventilating panel.

5. The window of claim 4, wherein:

said inner side ventilating panel slides parallel to the inner window to open, thus making the inside surface of the opposing outer side panel accessible for cleaning;

said inner side panel pivots inward about an axis located at the edge nearest the window frame, thus making accessible for cleaning its outside surface, the inside surface of the opposing outer side panel, and the outside surface of the inner center panel; and said inner side ventilating panel slides parallel to the inner window, while said inner side panel and said inner center panel are open, to a position next to the closed position of the inner side panel, thus making its outside surface accessible for cleaning from the opening provided by the inner center panel.

6. The window of claim 1, wherein said outer side panels are permanently secured in a closed position.

7. The window of claim 2, wherein said outer side panels are permanently secured in a closed position.

8. The window of claim 4, wherein said outer side panels are permanently secured in a closed position.

* * * * *